US010423086B2

(12) United States Patent
Hama et al.

(10) Patent No.: US 10,423,086 B2
(45) Date of Patent: Sep. 24, 2019

(54) TONER

(71) Applicant: CANON KABUSHIKI KAISHA, Tokyo (JP)

(72) Inventors: Masayuki Hama, Toride (JP); Takeshi Hashimoto, Moriya (JP); Yuto Onozaki, Saitama (JP); Ichiro Kanno, Kashiwa (JP); Nozomu Komatsu, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/992,467

(22) Filed: May 30, 2018

(65) Prior Publication Data

US 2018/0356746 A1 Dec. 13, 2018

(30) Foreign Application Priority Data

Jun. 9, 2017 (JP) ..... 2017-114211

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 5/147*** | (2006.01) |

(52) U.S. Cl.

CPC ..... *G03G 9/0819* (2013.01); *G03G 5/14756* (2013.01); *G03G 9/0823* (2013.01); *G03G 9/0827* (2013.01); *G03G 9/08755* (2013.01); *G03G 9/09708* (2013.01); *G03G 9/09725* (2013.01)

(58) Field of Classification Search

CPC ..... G03G 9/09708; G03G 9/09716

See application file for complete search history.

(56) References Cited

U.S. PATENT DOCUMENTS

| | | | |
|---|---|---|---|
| 5,968,701 | A | 10/1999 | Onuma et al. |
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,430,384 | B2 | 8/2002 | Hama et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 7,112,395 | B2 | 9/2006 | Ida et al. |
| 7,135,263 | B2 | 11/2006 | Kawakami et al. |
| 7,147,980 | B2 | 12/2006 | Itakura et al. |
| 7,147,981 | B2 | 12/2006 | Fujikawa et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,256,148 | B2 | 2/2016 | Fujikawa et al. |
| 9,348,253 | B2 | 5/2016 | Kanno et al. |
| 9,394,413 | B2 | 7/2016 | Yoshikawa et al. |
| 9,417,540 | B2 | 8/2016 | Hashimoto et al. |
| 9,500,975 | B2 | 11/2016 | Sugahara et al. |
| 9,599,920 | B2 | 3/2017 | Sugahara et al. |
| 9,651,883 | B2 | 5/2017 | Hama et al. |
| 9,665,023 | B2 | 5/2017 | Kamae et al. |
| 9,665,026 | B2 | 5/2017 | Iwasaki et al. |
| 9,778,598 | B2 | 10/2017 | Onozaki et al. |
| 9,958,809 | B2 | 5/2018 | Sugahara et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0244159 | A1 | 9/2013 | Ishigami et al. |
| 2013/0288173 | A1 | 10/2013 | Hashimoto et al. |

(Continued)

FOREIGN PATENT DOCUMENTS

| | | |
|---|---|---|
| JP | 2012-149169 A | 8/2012 |
| JP | 2012-163623 A | 8/2012 |
| JP | 2013-190646 A | 9/2013 |

OTHER PUBLICATIONS

U.S. Appl. No. 15/886,965, Takeshi Hashimoto, filed Feb. 2, 2018.

(Continued)

*Primary Examiner* — Peter L Vajda

(74) *Attorney, Agent, or Firm* — Venable LLP

(57) ABSTRACT

Provided is a toner containing: a toner particle containing a binder resin; and an inorganic particle, wherein the inorganic particle contains a silicon oxide particle with a number-average particle diameter (D1) from 50 nm to 300 nm and a strontium titanate particle with a number-average particle diameter (D1) from 10 nm to 60 nm, the content of the silicon oxide particle is from 0.5 to 15.0 mass parts per 100 mass parts of the toner particle, the content of the strontium titanate particle is from 0.02 to 5.00 times the content of the silicon oxide particle, and in dielectric constant measurement at 25° C. and 1 MHz, the dielectric constant of the silicon oxide particle is from 1.0 pF/m to 20.0 pF/m, and the dielectric constant of the strontium titanate is from 25.0 pF/m to 100.0 pF/m.

4 Claims, No Drawings

(56) References Cited

U.S. PATENT DOCUMENTS

| | | | | |
|---|---|---|---|---|
| 2014/0134535 | A1 | 5/2014 | Baba et al. | |
| 2014/0329176 | A1 | 11/2014 | Kanno et al. | |
| 2015/0104739 | A1 | 4/2015 | Nagatomo et al. | |
| 2016/0363877 | A1 | 12/2016 | Hama et al. | |
| 2017/0212439 | A1* | 7/2017 | Srinivasan | G03G 9/0904 |
| 2017/0315461 | A1 | 11/2017 | Komatsu et al. | |
| 2017/0315463 | A1 | 11/2017 | Onozaki et al. | |
| 2017/0343911 | A1 | 11/2017 | Hashimoto et al. | |
| 2017/0357168 | A1 | 12/2017 | Kanno et al. | |
| 2018/0149990 | A1 | 5/2018 | Onozaki et al. | |
| 2018/0149992 | A1 | 5/2018 | Onozaki et al. | |
| 2018/0246432 | A1* | 8/2018 | Nishikawa | G03G 9/08797 |

OTHER PUBLICATIONS

U.S. Appl. No. 15/912,698, Hitoshi Sano, filed Mar. 6, 2018.
U.S. Appl. No. 15/955,291, Megumi Ikeda, filed Apr. 17, 2018.
U.S. Appl. No. 15/996,884, Yuto Onozaki, filed Jun. 4, 2018.

* cited by examiner

TONER

BACKGROUND OF THE INVENTION

Field of the Invention

The present invention relates to a toner for use in electrophotographic systems, electrostatic recording systems, electrostatic printing systems and toner jet systems.

As copiers and printers become more widespread, more advanced toner performance is being required. In recent years attention has focused on a digital printing technology called "print on demand (POD)", whereby material is printed directly without passing through a page makeup process. Printing on demand (POD) is suited to small-lot printing, variable printing (in which the content changes on each sheet), and dispersed printing, which gives it an advantage over conventional offset printing. Considering the application of image-forming methods using toner to the POD market, what is needed is to stably obtain high-quality printed images rapidly and over a long period of time even when outputting in large quantities.

In the past, there have been many proposals for adding large-diameter particles capable of conferring a spacer effect to the toner particle with the aim of maintaining stable flowability in the long term.

For example, Japanese Patent Application No. 2012-149169 proposes maintaining toner flowability by adding to the toner particle a differently-shaped silica particle formed by the sol-gel method.

Japanese Patent Application No. 2012-163623 proposes a toner whereby fogging of the non-image part is controlled by adding a silica particle with a specific surface area from 10.0 $m^2/g$ to 50.0 $m^2/g$ to the toner particle, which is then surface treated with heat.

Japanese Patent Application No. 2013-190646 proposes a toner whereby transferability is improved and image defects are controlled by adding a non-spherical silica particle to the toner particle.

SUMMARY OF THE INVENTION

However, toners using large-diameter silicon compound fine particles that confer a spacer effect have room for improvement in terms of the effects of the environment on charge stability and flowability.

More specifically, toners to which large-diameter silica particles have been added are liable to variation in charging speed in low-humidity environments in particular, and the charge quantity of the toner is not stable in cases in which a large amount of toner is consumed in a solid image or the like and the toner replacement speed in the developing device is high. In particular, when toner that has undergone friction in the developing device is mixed with toner that has just been supplied to the developing device, toner is likely to be generated with inversed polarity, resulting in toner scattering from the developing device, contaminating the inside of the image-forming apparatus, and disturbing the toner image on the image bearing member.

It is an object of the present invention, which was developed in light of these problems, to provide a toner having superior environmental stability and durability, whereby stable images can be obtained in a variety of temperature and humidity environments.

These problems can be solved with a toner of the following configuration.

That is, the present invention is a toner containing: a toner particle containing a binder resin; and an inorganic particle, wherein the inorganic particle contains a silicon oxide particle with a number-average particle diameter (D1) from 50 nm to 300 nm and a strontium titanate particle with a number-average particle diameter (D1) from 10 nm to 60 nm, the content of the silicon oxide particle is from 0.5 to 15.0 mass parts per 100 mass parts of the toner particle, the content of the strontium titanate particle is from 0.02 to 5.00 times the content of the silicon oxide particle, and in dielectric constant measurement at 25° C. and 1 MHz, the dielectric constant of the silicon oxide particle is from 1.0 pF/m to 20.0 pF/m, and the dielectric constant of the strontium titanate is from 25.0 pF/m to 100.0 pF/m.

With the present invention, it is possible to obtain a toner satisfactory in both environmental stability and durability, whereby stable images can be obtained in a variety of temperature and humidity environments.

Further features of the present invention will become apparent from the following description of exemplary embodiments.

DESCRIPTION OF THE EMBODIMENTS

Unless otherwise specified, descriptions of numerical ranges such as "from A to B" or "A to B" in the present invention include the numbers at the upper and lower limits of the range.

Embodiments for carrying out the present invention are explained in detail below.

The toner of the present invention is a toner containing: a toner particle containing a binder resin; and an inorganic particle, wherein the inorganic particle contains a silicon oxide particle with a number-average particle diameter (D1) from 50 nm to 300 nm and a strontium titanate particle with a number-average particle diameter (D1) from 10 nm to 60 nm, the content of the silicon oxide particle is from 0.5 to 15.0 mass parts per 100 mass parts of the toner particle, the content of the strontium titanate particle is from 0.02 to 5.00 times the content of the silicon oxide particle, and in dielectric constant measurement at 25° C. and 1 MHz, the dielectric constant of the silicon oxide particle is from 1.0 pF/m to 20.0 pF/m, and the dielectric constant of the strontium titanate is from 25.0 pF/m to 100.0 pF/m.

Using such a toner, it is possible to obtain stable images in a variety of temperature and humidity environments.

The mechanism of action is believed by the inventors to be as follows.

A large-diameter silicon oxide (silica) particle is advantageous for embedding during long-term use, and has a high charge maintenance rate. However, the band gap (the energy gap between the conduction band and the valence band) is about 7.9 eV, and the large particle diameter means that the surface area is low, so charging speeds are slow particularly in low-humidity environments where the effect of moisture is small.

Consequently, fresh toner arriving in the developing unit from the toner hopper takes time to charge. To address this problem, it is believed that charge accumulation on the silicon oxide particles can be accelerated and the charge quantity and charge quantity distribution can be stabilized by include a small-diameter strontium titanate particle that has a small band gap and easily stores and releases charge due to its low dielectricization.

Thanks to these effects, it is possible to achieve a degree of environmental stability and durability that allows stable images to be obtained in a variety of temperature and humidity environments. That is, it is possible to obtain a toner that has improved charge maintenance and charge rising performance while maintaining a spacer effect throughout long-term use. As a result, charging is stabilized during long-term use, and image density is stable even when high-duty images are output continuously in normal-temperature, low-humidity environments, while toner scattering is controlled and unnecessary toner consumption is reduced in high-temperature, high-humidity environments.

The materials that can be used in the toner are explained below.

Silicon Oxide (Silica) Particle

The toner of the present invention features a silicon oxide (silica) particle with a number-average particle diameter from 50 nm to 300 nm. If the diameter of the silicon oxide particle is within this range, the protrusions formed by the silicon oxide on the surface of the toner particle can be maintained even when the toner is subject to mechanical load inside the developing apparatus. This helps to prevent a loss of toner charge quantity, and to reduce fogging and variation in reflection density. The number-average particle diameter of the silicon oxide particle is preferably from 80 nm to 200 nm. Moreover, in the particle size distribution the peak top of the number frequency is preferably within the aforementioned particle size range.

The dielectric constant of the silicon oxide particle itself does not vary much in general, but can be altered by the materials used in surface treatment. To achieve a balance of charge quantity and charge quantity retention, the dielectric constant of the silicon oxide particle is from 1.0 pF/m to 20.0 pF/m, or preferably from 3.0 pF/m to 5.0 pF/m.

The silicon oxide particle can be manufactured by a known manufacturing method such as a combustion method or hydrothermal synthesis. An amorphous silica particle produced by a combustion method is desirable because it is less likely to be affected by moisture in the atmosphere.

Moreover, preferably the surface of the silicon oxide particle is hydrophobically treated with a fatty acid or metal salt thereof, silicone oil, or a silane coupling agent, titanium coupling agent or the like, and of these a silane coupling agent such as hexamethyldisiloxane (HMDS), octyltriethoxysilane or dichlorosilane is preferred.

The content of the silicon oxide particle is from 0.5 to 15.0 mass parts per 100 mass parts of the toner particle. Within this range, it is possible to ensure a sufficient abundance on the toner surface of particles capable of adequately exerting the spacer effect of large-diameter silicon oxide particles, while still preserving good fixability of the toner on the paper medium. The content is preferably from 0.8 to 8.0 mass parts. The toner can be manufactured by mixing the silicon oxide particle with the toner particle by an ordinary external addition method. Mixing can be performed with a known mixer such as a Henschel mixer.

To control movement of the silicon oxide particle from the toner particle surface to other materials or prevent uneven distribution due to movement on the toner particle surface, preferably part of the silicon oxide particle is embedded in the toner particle surface. Embedding may be accomplished by hot air treatment or mechanical impact treatment or the like either during or after mixing of the toner particle and silicon oxide particle. The amount of the silicon oxide particle embedded in the toner particle is preferably from 5% to 70% of the diameter of the silicon oxide particle, or more preferably from 15% to 60%.

Strontium Titanate Particle

The toner of the present invention contains a strontium titanate fine particle with a number-average particle diameter from 10 nm to 60 nm. If the particle diameter is within this range, suitable opportunities are obtained for contact and triboelectric charging between the silicon oxide particles and the strontium titanate particles, which thus function as a charging aid. The number-average particle diameter of the strontium titanate particles is preferably from 20 nm to 45 nm. In the particle size distribution, the peak top of the number frequency is preferably within the aforementioned particle size range.

The strontium titanate particle used in the present invention has a lower dielectric constant than ordinary strontium titanate. The dielectric constant is from 25 pF/m to 100 pF/m, and within this range the ability of the particles to be charged and transfer the charge to the silicon oxide particles is improved, the charging aid performance is excellent, and charging of the silicon oxide particles can be accelerated. The dielectric constant is preferably from 30 pF/m to 70 pF/m, or more preferably not more than 50 pF/m.

To improve the environmental stability of charge and the durable stability in high-temperature, high-humidity environments, the surface of the strontium titanate particle is preferably hydrophobically treated with a fatty acid or fatty acid metal salt, silicone oil, a silane coupling agent, a titanium coupling agent or the like. To improve the environmental stability of the toner charge, the hydrophobicity of the strontium titanate particle is preferably from 20% to 80%.

The volume resistivity of the strontium titanate particle is preferably from $2.0\times10^{9}$ Ω·cm to $2.0\times10^{12}$ Ω·cm in order to obtain a sharper charge quantity distribution and improve transfer uniformity while controlling charge injection due to transfer bias. More preferably, it is from $1.0\times10^{10}$ Ω·cm to $1.0\times10^{12}$ Ω·cm. The volume resistivity of the strontium titanate particle can be controlled by means of the degree of surface hydrophobic treatment.

Because charge uniformity can be improved and fogging controlled the greater the flowability of the strontium titanate particle, a rolling shape is preferred. Specifically, the particle can contribute more efficiently to charging performance if the content of cubic and cuboid shaped particles is small. The content of cubic and cuboid shaped particles is preferably 40% by number or less, or more preferably 4% by number or less, or still more preferably 1% by number or less. The lower limit is not particularly limited, but is preferably at least 0.1% by number.

The content of the strontium titanate particle in the toner is from 0.02 to 5.00 times the content of the silicon oxide particle from the perspective of charging assistance to the silicon oxide particle. If the content is too much over 5.00 times, charge maintenance by the silicon oxide particle is harder to achieve. Preferably the content is from 0.05 to 2.00 times.

Furthermore, the content of the strontium titanate particle is preferably from 0.1 to 2.0 mass parts per 100 mass parts of the toner particle.

The toner particle and strontium titanate particle may be mixed using a known mixer such as a Henschel mixer, Mechano Hybrid (Nippon Coke & Engineering Co., Ltd.), Super Mixer or Nobilta (Hosokawa Micron Corporation), without any particular limitations.

The strontium titanate particle can be obtained for example by a normal pressure heating reaction method. In this case, the titanium oxide source is preferably a hydrolysate of a titanium compound peptized with a mineral acid, and the strontium oxide source is preferably a water-soluble acidic strontium compound. A mixture of these is reacted as an aqueous alkali solution is added at 60° C. or more, and then acid treated to manufacture the particle.

Normal Pressure Heating Reaction Method

A hydrolysate of a titanium compound peptized with a mineral acid may be used as the titanium oxide source. Preferably, metatitanic acid obtained by the sulfate method with a $SO_3$ content of not more than 1.0 mass % or preferably not more than 0.5 mass % that has been adjusted the pH to be from 0.8 to 1.5 with hydrochloric acid and peptized can be used.

A metal nitric acid salt or hydrochloric acid salt or the like may be used as the strontium oxide source, and for example strontium nitrate or strontium chloride may be used.

A caustic alkali may be used as the aqueous alkali solution, and a sodium hydroxide aqueous solution is particularly desirable.

In the method for manufacturing the strontium titanate particle, factors affecting the particle diameter include the mixing ratio of the titanium oxide source and strontium oxide source during the reaction, the titanium oxide source concentration at the start of the reaction, and the temperature and addition speed when adding the aqueous alkali solution. These may be adjusted appropriately in order to obtain the desired particle diameter and particle size distribution. Carbon dioxide gas contamination is preferably prevented by a means such as reacting the components in a nitrogen gas atmosphere in order to prevent carbonate formation during the reaction process.

In the method for manufacturing the resulting strontium titanate particle, factors affecting the dielectric constant include conditions and operations that break down the particle crystallinity. To obtain a strontium titanate particle with a low dielectric constant in particular, it is desirable to include an operation of applying energy to disturb crystal growth after increasing the concentration of the reaction solution. One specific method is to perform microbubbling with nitrogen during the crystal growth process for example. The content of particles with cubic and cuboid shapes can also be controlled by means of the nitrogen microbubbling flow rate.

The mixing ratio of the titanium oxide source and strontium oxide source during the reaction is preferably 0.9 to 1.4, or more preferably 1.05 to 1.20 (molar ratio of $SrO/TiO_2$). Within this range, unreacted titanium oxide is unlikely to persist. The concentration of the titanium oxide source at the beginning of the reaction is preferably 0.05 to 1.3 mol/L, or more preferably 0.08 to 1.0 mol/L as $TiO_2$.

The temperature when adding the aqueous alkali solution is preferably 60° C. to 100° C. The slower the addition speed of the aqueous alkali solution, the larger the particle diameter of the resulting strontium titanate particles, and the faster the addition speed, the smaller the particle diameter of the strontium titanate particles. The addition speed of the aqueous alkali solution is preferably 0.001 to 1.2 equivalents of the stock materials per hour, or more preferably 0.002 to 1.1 equivalents of the stock materials per hour, and may be adjusted appropriately according to the desired particle diameter.

Acid Treatment

A strontium titanate particle obtained by a normal pressure heating reaction is preferably then acid treated. When the mixing ratio of the titanium oxide source and the strontium oxide source exceeds a molar ratio $SrO/TiO_2$ of 1.0 when synthesizing a strontium titanate particle by a normal pressure heating reaction, unreacted metal sources other than titanium remaining after completion of the reaction may react with carbon dioxide gas in the air, producing impurities such as metal carbonates. When impurities such as metal carbonates are present on the particle surface, an organic surface treatment agent cannot be applied uniformly due to the effect of the impurities when the particle is subjected to organic surface treatment to confer hydrophobicity. Consequently, acid treatment to remove unreacted metal sources is desirable after addition of the aqueous alkali solution.

During acid treatment, the pH is preferably adjusted to 2.5 to 7.0 or more preferably 4.5 to 6.0 with hydrochloric acid. Apart from hydrochloric acid, acid treatment may also be performed with nitric acid, acetic acid or the like.

Other External Additives

In addition to the silicon oxide particle and strontium titanate particle described above, another inorganic fine powder may also be included in the toner as necessary to adjust the charge quantity or flowability. The inorganic fine powder may be added either internally or externally to the toner particle. Inorganic fine powders such as silica, titanium oxide, aluminum oxide, magnesium oxide and calcium carbonate are desirable as external additives. The inorganic fine powder has preferably been hydrophobized with a hydrophobic agent such as a silane compound, silicone oil or a mixture of these.

The external additive added as necessary is preferably used in the amount from 0.1 to 10.0 mass parts per 100 mass parts of the toner particle. The toner particle and external additive can be mixed with a known mixer such as a Henschel mixer.

Binder Resin

The toner particle contains a binder resin. The binder resin is not particularly limited, and the following polymers or resins may be used.

For example monopolymers of styrene and substituted styrene, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymers, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinylbutyral, terpene resin, coumarone-indene resin and petroleum-based resin may be used.

Of these, a polyester resin is desirable from the standpoint of low-temperature fixability and charging performance control.

A resin having a "polyester unit" in the binder resin chain is preferred as a polyester resin. Specific examples of the components making up this polyester unit include dihydric and higher alcohol monomer components, and acid monomer components such as divalent and higher carboxylic acids, divalent and higher caboxylic anhydrides and divalent and higher carboxylic acid esters and the like.

The following are examples of dihydric and higher alcohol monomer components: bisphenol A alkylene oxide adducts, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane, and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, 1,3,5-trihydroxymethylbenzene and the like.

Of these, the aromatic diols can be used by preference as alcohol monomer components, and an aromatic diol is preferably included in the amount of at least 80 mol % in the alcohol monomer components constituting the polyester resin.

The following are examples of acid monomer components such as divalent and higher carboxylic acids, divalent and higher caboxylic anhydrides and divalent and higher carboxylic acid esters: aromatic dicarboxylic acids such as phthalic acid, isophthalic acid and terephthalic acid, or their anhydrides; alkyldicarboxylic acids such as succinic acid, adipic acid, sebacic acid and azelaic acid, or their anhydrides; succinic acids substituted with $C_{6-18}$ alkyl or alkenyl groups, or their anhydrides; and unsaturated dicarboxylic acids such as fumaric acid, maleic acid and citraconic acid, or their anhydrides.

Of these, acid monomer components that can be used by preference include polyvalent carboxylic acids such terephthalic acid, succinic acid, adipic acid, fumaric acid, trimellitic acid, pyromellitic acid and benzophenonetetracarboxylic acid and their anhydrides.

The acid value of the polyester resin is preferably not more than 20 mg KOH/g from the standpoint of pigment dispersibility and stability of the triboelectric charge quantity.

The acid value can be kept within this range by adjusting the types and compounded amounts of the monomers used in the resin. Specifically, it can be controlled by adjusting the ratios and molecular weights of the alcohol monomer components and acid monomer components during resin manufacture. It can also be controlled by reacting the terminal alcohols with a polyvalent acid monomer (such as trimellitic acid) after ester condensation polymerization.

Colorant

A colorant may also be contained in the toner particle. The following are examples of colorants.

Examples of black colorants include carbon black, and blacks obtained by color adjustment of blending yellow, magenta and cyan colorants. A pigment may be used alone as the colorant, but from the standpoint of image quality with full-color images, preferably a dye and a pigment are used together to improve the color clarity.

Examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269 and 282; C.I. Pigment Violet 19; and C.I. Vat Red 1, 2, 10, 13, 15, 23, 29 and 35.

Examples of magenta dyes include C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; oil-soluble dyes such as C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39 and 40 and C.I. Basic Violet 1, 3, 7, 10, 14, 15, 21, 25, 26, 27 and 28.

Examples of cyan pigments include C.I. Pigment Blue 2, 3, 15:2, 15:3, 15:4, 16 and 17; C.I. Vat Blue 6; C.I. Acid Blue 45, and copper phthalocyanine pigments having 1 to 5 phthalimidomethyl groups substituted on a phthalocyanine skeleton.

Examples of cyan dyes include C.I. Solvent Blue 70.

Examples of yellow pigments include C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181 and 185; and C.I. Vat Yellow 1, 3, and 20.

Examples of yellow dyes include C.I. Solvent Yellow 162.

The content of the colorant is preferably from 0.1 to 30 mass parts per 100 mass parts of the binder resin.

Wax

A wax may also be used in the toner particle. Examples of the wax include the following: hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax, and block copolymers of these; waxes consisting primarily of fatty acid esters, such as carnauba wax; and partially or fully deoxidized fatty acid esters, such as deoxidized carnauba wax.

Other examples include the following: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, seryl alcohol and melissyl alcohol; polyvalent alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, seryl alcohol and mellisyl alcohol; fatty acid amides such as linoleamide, oleamide and lauramide; saturated fatty acid bisamides such as methylenebis stearamide, ethylenebis capramide, ethylenebis lauramide and hexamethylenebis stearamide; unsaturated fatty acid amides such as ethylenebis oleamide, hexamethylenebis oleamide, N,N'-dioleyladipamide and N,N'-dioleylsebacamide; aromatic bisamides such as m-xylenebis stearamide and N,N'-distearylisophthalamide; aliphatic metal salts (commonly called metal soaps) such as calcium stearate, calcium laurate, zinc stearate and magnesium stearate; aliphatic hydrocarbon waxes grafted with vinyl monomers such as styrene or acrylic acid; partially esterified products of fatty acids and polyvalent alcohols, such as behenic acid monoglyceride; and methyl ester compounds with hydroxyl groups obtained by hydrogenation of plant-based oils and fats.

Of these waxes, a hydrocarbon wax such as paraffin wax or Fischer-Tropsch wax or a fatty acid ester wax such as carnauba wax is preferred for improving low-temperature fixability and hot offset resistance.

The content of the wax is preferably from 1.0 to 15 mass parts per 100 mass parts of the binder resin. Hot offset resistance is good if the wax content is within this range.

To obtain both storage stability and hot offset resistance of the toner, the peak temperature of the maximum endothermic peak from 30° C. to 200° C. in an endothermic curve obtained during temperature rise by differential scanning calorimetry (DSC) of the wax is preferably from 50° C. to 110° C.

Wax Dispersant

A resin having both polar segments resembling the wax component and segments close to the resin polarity may also be added as a wax dispersant to increase the dispersibility of the wax in the binder resin. Specifically, a styrene acrylic resin graft-modified with a hydrocarbon compound is preferred.

The charge maintaining property of the toner is improved if the resin part of the wax dispersant has a cyclic hydrocarbon group or aromatic ring introduced therein. This is desirable because it prevents the charging aid properties of the strontium titanate particle of the invention from being reduced in the toner particle.

Charge Control Agent

A charge control agent may be included as necessary in the toner. A known charge control agent may be used in the toner, but a metal compound of an aromatic carboxylic acid is especially desirable because it is colorless and yields a toner particle that has a rapid charging speed and can stably maintain a fixed charge quantity.

Examples of negatively-charging charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes.

Examples of positively-charging charge control agents include quaternary ammonium salts, polymeric compounds having such quaternary ammonium salts in the side chains, and guanidine compounds and imidazole compounds.

The charge control agent may be added either internally or externally to the toner base particle. The added amount of the charge control agent is preferably from 0.2 to 10 mass parts per 100 mass parts of the binder resin.

Developer

The toner of the present invention may be used as a one-component developer, but is preferably mixed with a magnetic carrier and used as a two-component developer in order to further improve dot reproducibility and obtain stable images over a long period of time.

The following known carriers may be used as the magnetic carrier: surface-oxidized iron powders or non-oxidized iron powders, metal particles such as iron, lithium, calcium, magnesium, nickel, copper, zinc, cobalt, manganese, chromium and rare earth particles, alloy and oxide particles of these, magnetic bodies such as ferrite, and magnetic body-dispersed resin carriers (so-called resin carriers) containing a magnetic body and a binder resin that holds the magnetic body in a dispersed state.

Regarding the mixing ratio of the carrier when the toner is mixed with a magnetic carrier and used as a two-component developer, the toner concentration in the two-component developer is preferably from 2 to 15 mass %, or more preferably from 4 to 13 mass %.

Manufacturing Method

The method for manufacturing the toner particle is not particularly limited as long as it is a known method such as an emulsion aggregation method, melt kneading method or dissolution suspension method, but a melt kneading method is preferred for increasing the dispersibility of the raw materials.

In the melt kneading method, a toner composition consisting of the raw materials of the toner particle is melt kneaded, and the kneaded product is then pulverized. Examples of the manufacturing method are explained here.

In a raw material mixing step, the materials constituting the toner particle, namely the binder resin together with other components such as a colorant, wax, charge control agent and the like as necessary, are weighed in specific amounts, compounded and mixed. The mixing apparatus may be a double-cone mixer, V-shaped mixer, drum mixer, super mixer, Henschel mixer, Nauta mixer, Mechano Hybrid (Nippon Coke & Engineering Co., Ltd.) or the like for example.

Next, the mixed materials are melt kneaded to disperse the other raw materials and the like in the binder resin. Either a batch kneader such as a pressure kneader or Banbury mixer or a continuous kneader may be used in this melt kneading step, and generally a single- or twin-screw extruder is used because it is advantageous for continuous production. Specific examples include the KTK twin-screw extruder (Kobe Steel, Ltd.), TEM twin-screw extruder (Toshiba Machine Co., Ltd.), PCM kneader (Ikegai Corp.), twin-screw extruder (KCK), Ko-kneader (Buss AG), Kneadex (Nippon Coke & Engineering Co., Ltd.) and the like. The resin composition obtained by melt kneading can then be rolled with two rolls or the like, and cooled with water or the like in a cooling step.

Next, the cooled resin composition is pulverized to the desired particle diameter in a pulverization step. In the pulverization step, the material is first coarsely pulverized with a crushing apparatus such as a crusher, hammer mill or feather mill, and then finely pulverized with a pulverizer. Examples of pulverizers include the Kryptron system (Kawasaki Heavy Industries, Ltd.), Super Rotor (Nisshin Engineering Inc.) and Turbo Mill (Freund-Turbo Corporation), and pulverizers using air jet systems.

This can then be classified as necessary with a sieving or classifying apparatus such as an Elbow Jet (Nittetsu Mining Co., Ltd.) using inertial classification or a Turboplex (Hosokawa Micron Corporation), TSP Separator (Hosokawa Micron Corporation) or Faculty (Hosokawa Micron Corporation) using centrifugal classification to obtain a toner particle.

A weight-average diameter from 4.0 μm to 8.0 μm of the toner particle is desirable because the effect of the external additive can be sufficiently obtained. The circularity of the toner particle can also be increased by subjecting the particle to mechanical impact force or heat treating it with hot air or the like. The average circularity is preferably from 0.962 to 0.972 in order to maximize the charge transfer opportunities and frictional force between toner particles and increase the charge rising speed.

The inorganic particles and other external additives as necessary are added and mixed with the toner particle (external addition). The mixing apparatus may be a double-cone mixer, V-shaped mixer, drum mixer, super mixer, Henschel mixer, Nauta mixer, Mechano Hybrid (Nippon Coke & Engineering Co., Ltd.) or the like for example.

The methods for measuring the various physical properties of the toner and raw materials are explained below.

Calculating Number-average Particle Diameters of Inorganic Particles

The number-average particle diameter in the present invention is the number-average primary particle diameter. The number-average particle diameters of the silicon oxide particle and strontium titanate particle can be calculated from backscattered electron images of the inorganic particles taken with a Hitachi S-4800 Ultra-High Resolution Field Emission Scanning Electron Microscope (Hitachi High-Technologies Corporation). The imaging conditions of the S-4800 are as follows.

(1) Sample Preparation

A conductive paste is thinly coated on a sample stand (15 mm×6 mm aluminum sample stand), and the inorganic particle to be measured is blown onto the paste. Air is then blown to remove excess inorganic particles from the sample stand and thoroughly dry the particle. The sample stand is set in a sample holder, and the height of the sample stand is adjusted to 36 mm with a sample height gauge.

(2) Setting S-4800 Observation Conditions

The number-average particle diameter is calculated using images obtained from backscattered electron imaging with the S-4800. Liquid nitrogen is poured until overflowing into an anti-contamination trap attached to the case of the S-4800, and left for 30 minutes. The "PC-SEM" of the S-4800 is operated to perform flushing (purification of FE chip electron source). The acceleration voltage display part of the control panel on the image is clicked, and the "flushing" button is pressed to open a flushing execution dialog. This is executed after the flushing strength is confirmed to be 2. The emission current from flushing is then confirmed to be 20 μA to 40 μA. The sample holder is inserted into the sample chamber of the S-4800 case. "Origin" is pressed on the control panel to transfer the sample holder to the observation position.

The acceleration voltage display part is clicked to open an HV setting dialog, and the acceleration voltage is set to "1.1 kV" and the emission current to "20 μA". In the "basic" tab of the operation panel, the signal selection is set to "SE", "upper (U)" with "+BSE" is selected as the SE detector, and "L.A. 100" is selected with the selection button to the right of "+BSE" to set the backscattered electron imaging mode. In the same "basic" tab of the operation panel, the probe current of the electronic optical system condition block is set to "Normal", the focus mode to "UHR", and WD to "4.5 mm". The "On" button of the acceleration voltage display part on the control panel is pressed to apply acceleration voltage.

(3) Focus Adjustment

The "Coarse" focus knob on the operation panel is turned, and once a certain focus is achieved the aperture alignment is adjusted. "Align" is clicked on the control panel to display an alignment dialog, and "beam" is selected. The Stigma/Alignment knobs (X, Y) on the operation panel are turned, and the displayed beam is moved to the center of the concentric circle. "Aperture" is then selected, and the Stigma/Alignment knobs (X, Y) are turned one at a time until image movement stops or is minimized. The aperture dialog is closed, and the device is focused with the autofocus. The magnification is then set to 80,000× (80 k), the focus is adjusted with the focus knob and Stigma/Alignment knobs as before, and the device is focused again with the autofocus. These operations are repeated to achieve focus. Because the accuracy of coverage measurement is likely to decline if the tilt angle of the observed surface is too great, surface tilt is eliminated as much as possible by ensuring that the entire observed surface is in focus during focus adjustment.

(4) Image Storage

Brightness is adjusted in ABC mode, and 640×480 pixel photographs are taken and stored. The following analysis is performed using these image files. Multiple photographs are taken to obtain enough images so that at least 500 particles can be analyzed.

(5) Image Analysis

The particle diameters of at least 500 silicon oxide particles or strontium titanate particles are measured, and the number-average particle diameter is determined. The long diameter is measured as the particle diameter. In the present invention, images obtained by the methods described above are binarized with Image-Pro Plus ver. 5.0 image analysis software to calculate the number-average particle diameter.

The particle diameter of an inorganic particle on the toner particle surface can also be measured by similar methods. When measuring the particle diameter of an inorganic particle on the toner particle surface, the particle to be measured is first identified in advance on the toner particle surface by elemental analysis using an energy dispersive X-ray analyzer (EDAX) or the like.

Content Ratio of Cubic and Cuboid Forms of Strontium Titanate Particle

In the aforementioned electron microscopic images, the total number of strontium titanate particles with a particle diameter from 10 nm to 60 nm that have a cubic or cuboid shapes is counted, and the % by number is calculated. Cubic or cuboid here means having obvious angles. Measurement is performed on 100 strontium titanate particles.

Dielectric Constant Measurement

Using a 284A precision LCR meter (Hewlett-Packard Company) calibrated at frequencies of 1 kHz and 1 MHz, complex permittivity is measured at a frequency of 1 MHz. 39,200 kPa (400 kg/cm$^2$) of load is applied for 5 minutes to the silicon oxide particles and strontium titanate particles being measured, to mold the particles into disc-shaped measurement samples 25 mm in diameter and not more than 1 mm (preferably 0.5 mm to 0.9 mm) thick. Each measurement sample is mounted in an ARES (Rheometric Scientific F.E. Ltd.) equipped with a 25 mm diameter dielectric constant measuring jig (electrode) and subjected to 0.49 N (50 g) of load in a 25° C. atmosphere, and the dielectric constant is measured at a frequency of 1 MHz.

Volume Resistivity Measurement

The volume resistivity of the strontium titanate is measured as follows. A 6517 type electrometer/high resistance system manufactured by Keithley Instruments Inc. is used as the apparatus. Electrodes 25 mm in diameter are connected, strontium titanate particles are laid between the electrodes to a thickness of about 0.5 mm, about 2.0 N of load is applied, and the distance between the electrodes is measured.

The resistance value is measured when 1,000 V of voltage has been applied to the strontium titanate particles for 1 minutes, and the volume resistivity is calculated according to the following formula.

$$\text{Volume resistivity } (\Omega\cdot\text{cm}) = R \times L$$

R: Resistance (Ω)

L: Distance between electrodes (cm)

Method for Measuring Weight-average Particle Diameter (D4) of Toner Particle

The weight-average particle diameter (D4) of the toner particle is measured with a Coulter Counter Multisizer® 3 (Beckman Coulter, Inc.) precision particle size distribution measurement device based on the pore electrical resistance method and equipped with a 100 μm aperture tube, using the attached Multisizer 3 Version 3.51 dedicated software (Beckman Coulter, Inc.) to set the measurement conditions and analyze the measurement data. Measurement is performed with 25,000 effective measurement channels, and the measurement data are analyzed to calculate the particle diameter.

A solution of special-grade sodium chloride dissolved to a concentration of about 1 mass % in ion-exchange water, such as "Isoton II" (Beckman Coulter, Inc.), may be used as the electrolytic solution for measurement.

The following settings are performed on the dedicated software prior to measurement and analysis.

On the "Change Standard Operating Method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the threshold/noise level measurement button. The current is set to 1,600 μA, the gain to 2, and the electrolytic solution to Isoton II, and a check is entered for aperture tube flush after measurement.

On the "Conversion Setting from Pulse to Particle Diameter" screen of the dedicated software, the bin interval is set to the logarithmic particle diameter, the particle diameter bin is set to the 256 particle diameter bin, and the particle diameter range is set to a range from 2 μm to 60 μm.

The specific measurement methods are as follows.

(1) About 200 mL of the aqueous electrolytic solution is placed in a 250 mL glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 mL of the aqueous electrolytic solution is placed in a 100 mL glass flat-bottom beaker, and approximately 0.3 mL of the following diluted solution is added thereto as a dispersant.

Diluted solution: "Contaminon N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchange water (3) A predetermined amount of ion-exchange water is placed in the water bath of the following ultrasonic disperser with an electric output of 120 W in which two oscillators with an oscillation frequency of 50 kHz are built-in with the phases of the oscillators shifted by 180° to one other, and about 2 mL of the Contaminon N is added to the water bath.

Ultrasonic disperser: "Ultrasonic Dispersion System Tetora 150" (Nikkaki Bios Co., Ltd.)

(4) The beaker of (2) is set in a beaker-fixing hole of the ultrasonic disperser, and the ultrasonic disperser is operated. The height position of the beaker is adjusted so as to maximize the resonance state of the surface of the electrolytic solution in the beaker.

(5) The electrolytic solution in the beaker of (4) is exposed to ultrasound waves as approximately 10 mg of the toner is added little by little to the electrolytic solution and dispersed. Ultrasonic dispersion treatment is then continued for a further 60 seconds. During the ultrasonic dispersion, the temperature of the water in the water bath is adjusted as necessary so as to be from 15° C. to 40° C.

(6) Using a pipette, the electrolytic solution of (5) with the toner dispersed therein is added dropwise to the round-bottom beaker of (1) disposed on the sample stand, and the measurement concentration is adjusted to about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the analysis/volume statistical value (arithmetic average) screen when graph/vol % is set by the dedicated software.

Method for Measuring Average Circularity

The average circularity of the toner can be measured under the measurement and analysis conditions for calibration operations, using an FPIA-3000 flow-type particle image analyzer (Sysmex Corporation).

The specific measurement methods are as follows. First, about 20 mL of ion-exchange water from which solid impurities have been removed in advance is placed in a glass container. About 0.2 mL of a diluted solution of "Contaminon N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted about 3 times by mass with ion-exchange water is then added thereto as a dispersant. About 0.02 g of the measurement sample is then added, and dispersed for 2 minutes with an ultrasonic disperser to obtain a dispersion for measurement. During this process, cooling is performed appropriately so that the temperature of the dispersion is from 10° C. to 40° C. Using a tabletop ultrasonic washer and disperser with an oscillation frequency of 50 kHz and an electrical output of 150 W (VS-150, made by Velvo-Clear) as the ultrasonic disperser, a predetermined amount of ion-exchange water is placed in the water bath, and about 2 mL of Contaminon N is added to this water bath.

A flow type particle image analyzer equipped with a standard objective lens (10×) is used for measurement, and particle sheath (PSE-900A, Sysmex Corporation) is used as the sheath liquid. A dispersion prepared by the procedures described above is introduced into the flow type particle image analyzer, and 3,000 toner particles are measured in HPF measurement mode and in total count mode. The average circularity of the toner particle is then determined with the binarization threshold set to 85% during particle analysis, and with the analyzed particle diameters limited to circle-equivalent diameters from 1.985 μm to less than 39.69 μm.

Prior to the start of measurement, automatic focus adjustment is performed using standard latex particles ("Research and Test Particles Latex Microsphere Suspensions 5200A" (Duke Scientific Corporation) diluted with ion-exchange water). Preferably, focus adjustment is then performed every two hours after the start of measurement.

The flow-type particle image analyzer used in the examples of this application had been calibrated by Sysmex Corporation and been issued a calibration certificate by Sysmex Corporation. Measurement was performed under the same measurement and analysis conditions used when the calibration certificate was issued, except that the analyzed particle diameters were limited to circle-equivalent diameters from 1.985 μm to less than 39.69 μm.

Measuring Amount of Embedding of Silicon Oxide Particle

The amount of embedding of a silicon oxide particle in a toner particle can be determined from a backscattered electron image of a toner particle cross-section. The toner particle cross-section can be prepared by fixing the toner particle with epoxy resin, and cutting it by exposure to an argon ion beam with a cross-section polisher (CP). A cross-sectional image of the toner particle is obtained by backscattered electron photography with the aforementioned S-4800, and silicon oxide particles present on the outer edge of the toner particle are specified by EDAX element mapping.

The length embedded below the outline of the toner (L) and the diameter of the silicon oxide particle (Ds) are measured, and the amount of embedding is then calculated as L/Ds×100(%). The long diameter is measured as the particle diameter. The amount of embedding of 300 silicon oxide particles is measured, and the arithmetic average thereof is given as the amount of embedding.

EXAMPLES

The present invention is explained below using manufacturing examples and examples, but the present invention is in no way limited thereby. Parts in the compositions below are all based on mass unless otherwise specified.

Manufacturing Example of Strontium Titanate Particle 1

Metatitanic acid obtained by the sulfuric acid method was subjected to de-iron bleaching treatment, sodium hydroxide aqueous solution was added to raise the pH to 9.0, and desulfurization was performed, after which the pH was neutralized to 5.8 with hydrochloric acid, and the product was filtered and water washed. Water was added to the washed cake to obtain a slurry containing 1.5 mol/L of $TiO_2$, hydrochloric acid was added to lower the pH to 1.5, and peptizing treatment was performed.

The desulfurized and peptized metatitanic acid was collected as $TiO_2$, and placed in a 3 L reaction vessel. A strontium chloride aqueous solution was added to this peptized metatitanic acid slurry to a $SrO/TiO_2$ molar ratio of 1.15, after which the $TiO_2$ concentration was adjusted to 0.8 mol/L. This was then heated to 90° C. under stirring and mixing, and nitrogen gas microbubbling was performed at 600 mL/min as 444 mL of 10 mol/L sodium hydroxide aqueous solution were added over the course of 50 minutes, after which nitrogen gas microbubbling was continued at 400 mL/min as the slurry was stirred for 1 hour at 95° C.

Next, the reaction slurry was stirred and cooled rapidly to 15° C. as 10° C. cooling water was passed through the jacket of the reaction vessel, hydrochloric acid was added to pH 2.0, and stirring was continued for 1 hour. The resulting precipitate was washed by decantation, 6 mol/L hydrochloric acid was added to adjust the pH to 2.0, 7.0 parts of n-octylethoxysilane were added per 100 parts of solids, and stirring was performed for 18 hours. This was neutralized with 4 mol/L sodium hydroxide aqueous solution, stirred for 2 hours and then filtered and separated, and finally dried for 8 hours in a 120° C. atmosphere to obtain a powder 1. In powder X-ray analysis, the powder 1 exhibited the diffraction peaks of strontium titanate.

The particle 1 had an average primary particle diameter of 0.035 μm as calculated on a number basis from electron microscope observation, and the content of cubic and cuboid-shaped particles having obvious angles was 0.8% by number. The physical properties are shown in Table 1.

Manufacturing Examples of Strontium Titanate Particles 2 to 15

Strontium titanate particles 2 to 15 were manufactured by the same methods used to manufacture the particle 1 except that the sodium hydroxide addition times and nitrogen microbubbling flow rates were changed to the conditions shown in Table 1.

Manufacturing Examples of Strontium Titanate Particles 16 to 18

A titanyl sulfate aqueous solution was hydrolyzed to obtain a hydrous titanium oxide slurry, which was then washed with aqueous alkali solution. Next, hydrochloric acid was added to the hydrous titanium oxide slurry to adjust the pH to 0.65 and obtain a titania sol dispersion. NaOH was added to the titania sol dispersion to adjust the pH of the dispersion to 4.5, and washing was continued until the electrical conductivity of the supernatant was 70 μS/cm.

$Sr(OH)_2.8H_2O$ was added in the amount of 0.97 times the molar amount of the hydrous titanium oxide, the mixture was placed in a SUS reaction vessel, and nitrogen gas was substituted. Distilled water was then added in the amount from 0.1 to 2.0 mol/L of the $SrTiO_3$.

This dispersion was blown together with oxygen gas and propane gas from a particle spray nozzle into an 80 L combustion reaction tank, baked, and captured through a filter to obtain a fine particle. Pure water was added to the resulting fine particle to obtain a slurry, 6 mol/L hydrochloric acid was added to adjust the pH to 2.0, n-octylethoxysilane was added in the amount of 7.0 mass % of the solids, and the mixture was stirred for 18 hours. This was neutralized with 4 mol/L sodium hydroxide aqueous solution, stirred for 2 hours and then filtered, separated, and dried in a 120° C. atmosphere for 8 hours to obtain strontium titanate particles 16 to 18. These exhibited the diffraction peaks of strontium titanate in powder X-ray analysis measurement. The physical properties are shown in Table 1. When observed under an electron microscope, the strontium titanate particles 16 to 18 appeared amorphous without angles.

TABLE 1

| Strontium titanate particle No. | A | B | Silane compound treatment (parts) | Number-average particle diameter (nm) | Dielectric constant (pF/m) | C | Volume resistivity (Ω · cm) |
|---|---|---|---|---|---|---|---|
| 1 | 50 | 600 + 400 | 7 | 35 | 37 | 0.8 | 2.0E+10 |
| 2 | 50 | 600 + 300 | 7 | 35 | 38 | 4 | 2.0E+10 |
| 3 | 50 | 600 + 200 | 7 | 35 | 40 | 40 | 2.0E+10 |
| 4 | 50 | 600 + 100 | 7 | 35 | 42 | 45 | 2.0E+10 |
| 5 | 50 | 600 + 100 | 3 | 35 | 42 | 45 | 3.0E+09 |
| 6 | 50 | 600 + 100 | 11 | 35 | 42 | 45 | 2.0E+12 |
| 6-2 | 50 | 600 + 100 | 0.5 | 35 | 42 | 45 | 7.0E+08 |
| 7 | 50 | 600 + 100 | 14 | 35 | 42 | 45 | 2.0E+13 |
| 8 | 30 | 600 + 100 | 20 | 20 | 42 | 45 | 7.0E+12 |
| 9 | 120 | 600 + 100 | 9 | 50 | 42 | 45 | 3.0E+13 |
| 10 | 15 | 600 + 100 | 25 | 10 | 42 | 45 | 4.0E+12 |
| 11 | 180 | 600 + 100 | 8 | 60 | 42 | 45 | 3.0E+13 |
| 12 | 45 | 300 + 500 | 14 | 35 | 31 | 45 | 2.0E+13 |
| 13 | 50 | 600 + 75 | 14 | 35 | 47 | 45 | 2.0E+13 |

TABLE 1-continued

| Strontium titanate particle No. | A | B | Silane compound treatment (parts) | Number-average particle diameter (nm) | Dielectric constant (pF/m) | C | Volume resistivity (Ω · cm) |
|---|---|---|---|---|---|---|---|
| 14 | 55 | 600 + 25 | 14 | 35 | 65 | 45 | 2.0E+13 |
| 15 | 45 | 200 + 600 | 14 | 35 | 25 | 45 | 2.0E+13 |
| 16 | — | — | 14 | 35 | 100 | 0 | 3.0E+13 |
| 17 | — | — | 7 | 80 | 100 | 0 | 7.0E+12 |
| 18 | — | — | 14 | 35 | 120 | 0 | 4.0E+13 |

In the table, "A" indicates "NaOH aqueous solution addition time (min)", "B" indicates "N2 microbubbling flow rate (ml/min)", and "C" indicates "Content of cubic and cuboid shapes (%)".

In the table, a resistivity value of, for example, "2.0E+10" signifies $2.0\times10^{10}$.

Manufacturing Examples of Silicon Oxide Particles 1 to 7

A hydrocarbon-oxygen mixed burner with a double pipe structure capable of forming an internal flame and an external flame was used as the combustion furnace for manufacturing the silicon oxide particle 1. A two-fluid nozzle for slurry spraying is disposed in the center of the burner for introducing the raw material silicon compound. Hydrocarbon-oxygen flammable gas is sprayed from the periphery of the two-fluid nozzle, forming the outer and inner flames of a reducing atmosphere. The amounts and flow rates of the flammable gas and oxygen are controlled to adjust the atmosphere, the temperature, the length of the flame and the like. Silica fine particles are formed from the silicon compound in the flame, and are fused until the desired particle size is reached. That is, the particle size of the silica fine particles grows larger as the flow rate and flame are adjusted to extend the time that the silicon compound is treated in a high-temperature atmosphere. This is then cooled and captured with a bag filter or the like to obtain a particle.

Using hexamethylcyclotrisiloxane as the raw material silicon compound, an inorganic particle was manufactured, and 100 parts of the resulting inorganic particle were surface treated with 4 mass parts of hexamethyldisilazane to obtain a silicon oxide particle 1.

Particles of different particle sizes were obtained in the same way as the silicon oxide particle 1 by adjusting the size of the flame from the burner, the temperature and the flow rate. 100 parts of the resulting inorganic particles were surface treated with 10 parts, 2 parts, 12 parts and 1.5 parts of hexamethyldisilazane, respectively, to obtain silicon oxide particles 2, 3, 4 and 5.

The number-average particle diameters of the resulting silicon oxide particles 1 to 5 as observed under an electron microscope were 120 nm, 50 nm, 300 nm, 30 nm and 500 nm, respectively. The dielectric constant at 1 MHz was 3.8 pF/m in all cases.

A silicon oxide particle was also manufactured by the sol-gel method, and 100 parts of the resulting silicon oxide particle were surface treated with 10 parts of hexamethyldisilazane to obtain a silicon oxide particle 6 with a number-average particle diameter of 120 nm.

A silicon oxide particle 7 was also obtained by using a silicone oil treatment agent containing 10 mass % of dispersed titanium oxide particles with an average particle diameter of 5 nm in place of the surface treatment used in manufacturing the silicon oxide particle 6.

The dielectric constants of the silicon oxide particles 6 and 7 at 1 MHz were 1.2 pF/m and 19.5 pF/m, respectively.

Manufacturing Example of Binder Resin

Manufacturing Example of Polyester Resin

Polyoxypropylene(2.2)-2,2-bis(4-hydroxyphenyl)propane: 80.0 mol % of total mol % of polyvalent alcohol Polyoxyethylene(2.2)-2,2-bis(4-hydroxyphenyl)propane: 20.0 mol % of total mol % of polyvalent alcohol Terephthalic acid: 80.0 mol % of total mol % of polyvalent carboxylic acid Trimellitic anhydride: 20.0 mol % of total mol % of polyvalent carboxylic acid These materials were loaded into a reactor equipped with a cooling pipe, a stirrer, a nitrogen introduction pipe and a thermocouple. 1.5 parts of tin 2-ethylhexanoate (esterification catalyst) were added as a catalyst per 100 parts of the total monomers. Nitrogen was then substituted inside the flask, the temperature was raised gradually with stirring, and a reaction was performed for 2.5 hours with stirring at 200° C.

The pressure inside the reactor was lowered to 8.3 kPa and maintained for 1 hour, after which the mixture was cooled to 180° C. and reacted as is, and once the softening point was confirmed to have reached 110° C. as measured in accordance with ASTM D36-86, the temperature was lowered to stop the reaction. The resulting polyester resin had a softening point (Tm) of 115° C.

Manufacturing Example of Wax Dispersant 300.0 parts of xylene and 10.0 parts of polypropylene (melting point 75° C.) were placed in an autoclave reactor with an attached thermometer and stirrer and thoroughly melted, and nitrogen was substituted. A mixed solution of 73.0 parts of styrene, 5.0 parts of cyclohexyl methacrylate, 12.0 parts of butyl acrylate and 250.0 parts of xylene was then added dropwise for 3 hours at 180° C. to perform polymerization. This was then maintained for 30 minutes at this temperature to remove the solvent and obtain a wax dispersant.

Toner 1 Manufacturing Example

| | |
|---|---|
| Polyester resin | 100.0 parts |
| 3,5-di-t-butylsalicylic acid aluminum compound | 0.1 parts |
| Fischer-Tropsch wax (maximum endothermic peak temperature 90° C.) | 5.0 parts |
| Wax dispersant | 6.5 parts |
| C.I. Pigment Blue 15:3 | 5.0 parts |

The raw materials shown in the formulation above were mixed for a rotation time of 5 min at a rotational speed of 20 $s^{-1}$ with a Henschel Mixer (FM-75J, Mitsui Miike Chemical Engineering Machinery, Co., Ltd.) and then kneaded at 130° C. with a twin-screw kneader (PCM-30, Ikegai Corp.) set to a barrel rotation speed of 200 rpm. The resulting kneaded material was cooled, and coarsely pulverized with a hammer mill to 1 mm or less to obtain a coarsely pulverized material. The resulting coarsely pulverized material was finely pulverized with a mechanical pulverizer (T-250, Turbo Kogyo Co., Ltd.). This was then classified with a rotary classifier (200 TSP, Hosokawa Micron Corporation) to obtain a toner particle. The operating conditions of the rotary classifier (200 TSP, Hosokawa Micron Corporation) were a classifying rotor speed of 50.0 $s^{-1}$. The resulting toner particle had a weight-average particle diameter (D4) of 5.7 μm.

5.0 parts of the silicon oxide particle 1 and 0.2 parts of a hydrophobic silica fine particle with a primary average particle diameter of 10 nm that had been surface treated with 10.0 mass % hexamethyldisilazane were added per 100.0 parts of the resulting toner particle, and mixed in a Henschel Mixer (FM75J, Mitsui Miike Chemical Engineering Machinery, Co., Ltd.) at a rotational speed of 15 $s^{-1}$ for a rotation time of 10 min at a jacket temperature of 45° C.

0.5 parts of the strontium titanate particle 1 and a further 0.8 parts of a hydrophobic silica fine particle with a primary average particle diameter of 10 nm that had been surface treated with 10.0 mass % hexamethyldisilazane were then added, and mixed at a rotational speed of 30 $s^{-1}$ for a rotation time of 4 min at a jacket temperature of 20° C., after which the mixture was passed through a 54 μm mesh ultrasonic vibration screen to obtain a Toner 1 with an average circularity of 0.966. The physical properties of the Toner 1 are shown in Table 1.

Toner Manufacturing Example 2 to 33

Toners 2 to 33 were obtained as in the Toner manufacturing example 1 except that the types and amounts of the externally added strontium titanate particle and silicon oxide particle were changed as shown in Table 2.

TABLE 2

| Toner | Silicon oxide particle | | Strontium titanate particle | | Average | Embedded amount of large-diameter silicon |
|---|---|---|---|---|---|---|
| No. | No. | added amount (mass %) | No. | X | circularity | oxide particle (%) |
| 1 | 1 | 5 | 1 | 0.10 | 0.966 | 12% |
| 2 | 1 | 5 | 2 | 0.10 | 0.966 | 12% |
| 3 | 1 | 5 | 3 | 0.10 | 0.966 | 12% |
| 4 | 1 | 5 | 4 | 0.10 | 0.966 | 12% |
| 5 | 1 | 5 | 5 | 0.10 | 0.966 | 12% |
| 6 | 1 | 5 | 6 | 0.10 | 0.966 | 12% |
| 6-2 | 1 | 5 | 6-2 | 0.10 | 0.966 | 12% |
| 7 | 1 | 5 | 7 | 0.10 | 0.966 | 12% |
| 8 | 2 | 5 | 7 | 0.10 | 0.968 | 28% |
| 9 | 3 | 5 | 7 | 0.10 | 0.962 | 5% |
| 10 | 1 | 5 | 8 | 0.10 | 0.966 | 12% |
| 11 | 1 | 5 | 9 | 0.10 | 0.966 | 12% |
| 12 | 1 | 5 | 10 | 0.10 | 0.966 | 12% |
| 13 | 1 | 5 | 11 | 0.10 | 0.966 | 12% |
| 14 | 1 | 0.5 | 11 | 0.10 | 0.972 | 14% |
| 15 | 1 | 15 | 11 | 0.10 | 0.963 | 12% |
| 16 | 1 | 5 | 11 | 0.02 | 0.966 | 12% |
| 17 | 1 | 0.5 | 11 | 5.00 | 0.969 | 16% |
| 18 | 1 | 5 | 12 | 0.10 | 0.966 | 12% |
| 19 | 1 | 5 | 13 | 0.10 | 0.966 | 12% |
| 20 | 1 | 5 | 14 | 0.10 | 0.966 | 12% |
| 21 | 1 | 5 | 15 | 0.10 | 0.966 | 12% |
| 22 | 1 | 5 | 16 | 0.10 | 0.966 | 12% |
| 23 | 6 | 5 | 16 | 0.10 | 0.966 | 12% |
| 24 | 7 | 5 | 16 | 0.10 | 0.966 | 12% |
| 25 | 1 | 5 | 17 | 0.10 | 0.966 | 12% |
| 26 | 1 | 0.3 | 16 | 0.10 | 0.973 | 17% |
| 27 | 1 | 5 | 18 | 0.10 | 0.966 | 12% |
| 28 | — | 0 | 17 | 0.00 | 0.974 | — |

TABLE 2-continued

| Toner | Silicon oxide particle | | Strontium titanate particle | | Average | Embedded amount of large-diameter silicon |
|---|---|---|---|---|---|---|
| No. | No. | added amount (mass %) | No. | X | circularity | oxide particle (%) |
| 29 | 1 | 18 | 11 | 0.10 | 0.966 | 12% |
| 30 | 1 | 5 | 11 | 0.01 | 0.966 | 12% |
| 31 | 1 | 0.5 | 11 | 6.00 | 0.966 | 16% |
| 32 | 4 | 5 | 7 | 0.10 | 0.968 | 33% |
| 33 | 5 | 5 | 7 | 0.10 | 0.962 | 4% |

In the table, "X" indicates "Externally added ratio of strontium titanate particle to silicon oxide particle (x)".

Manufacturing Example of Magnetic Core Particle

Step 1. Weighing and Mixing Step

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 parts |

The ferrite raw materials were weighed to obtain the above compositional ratio of the materials. This was then pulverized and mixed for 5 hours in a dry vibration mill using stainless beads ⅛ inch in diameter.

Step 2. Pre-Baking Step

The resulting pulverized product was made into roughly 1 mm-square pellets in a roller compacter. These pellets were passed through a 3 mm mesh vibrating screen to remove coarse powder, and then passed through a 0.5 mm mesh vibrating screen to remove fine powder, after which they were baked for 4 hours at 1,000° C. in a nitrogen atmosphere (oxygen concentration 0.01 vol %) in a burner-type furnace to prepare a pre-baked ferrite. The composition of the resulting pre-baked ferrite is as follows.

$$(MnO)_a(MgO)_b(SrO)_c(Fe_2O_3)_d$$

In the formula, a=0.257, b=0.117, c=0.007 and d=0.393.

Step 3. Pulverization Step

This was crushed in a crusher to about 0.3 mm, after which 30 parts of water were added per 100 parts of the pre-baked ferrite, which was pulverized for 1 hour in a wet ball mill with zirconia beads ⅛ in in diameter. The resulting slurry was pulverized for 4 hours in a wet ball will with alumina beads 1/16 inch in diameter to obtain a ferrite slurry (finely pulverized pre-baked ferrite).

Step 4. Granulation Step 1.0 part of ammonium polycarbonate as a dispersant and 2.0 parts of polyvinyl alcohol as a binder were added per 100 parts of the pre-baked ferrite to the ferrite slurry, which was then granulated into spherical particles in a spray dryer (manufactured by Ohkawara Kakohki Co., Ltd.). The resulting particles were subjected to particle size adjustment, and heated for 2 hours at 650° C. in a rotary kiln to remove the organic components of the dispersant and binder.

Step 5. Baking Step

The temperature was raised from room temperature to 1,300° C. over 2 hours in a nitrogen atmosphere (oxygen concentration 1.00 vol %) in an electrical furnace to control the baking atmosphere, and the particles were baked for 4 hours at 1,150° C. The temperature was then lowered to 60° C. over the course of 4 hours, the atmosphere was returned from nitrogen to atmosphere, and the particles were removed at 40° C. or less.

Step 6. Selection Step

Aggregated particles were broken up, the low-magnetic product was excluded with a magnetic dressing, and coarse particles were removed by sieving with a 250 μm mesh sieve to obtain a magnetic core particle 1 with a median diameter of 37.0 μm based on volume distribution.

Preparation of Coating Resin

| | |
|---|---|
| Cyclohexyl methacrylate monomer | 26.8 mass % |
| Methyl methacrylate monomer | 0.2 mass % |
| Methyl methacrylate macromonomer | 8.4 mass % |

(macromonomer with weight-average molecular weight of 5,000 having methacryloyl group at one end)

| | |
|---|---|
| Toluene | 31.3 mass % |
| Methyl ethyl ketone | 31.3 mass % |
| Azobisisobutyronitrile | 2.0 mass % |

Of these materials, the cyclohexyl methacrylate, methyl methacrylate, methyl methacrylate macromonomer, toluene and methyl ethyl ketone were placed in a four-necked separable flask with an attached reflux condenser, thermometer, nitrogen introduction pipe and stirring apparatus, and nitrogen gas was introduced to purge the system with nitrogen. This was then heated to 80° C., and the azobisisobutyronitrile was added and refluxed for 5 hours to polymerize the mixture. Hexane was poured into the resulting reaction product to precipitate a copolymer, and the precipitate was filtered out and vacuum dried to obtain a coating resin 1. 30 parts of the resulting coating resin 1 were dissolved in 40 parts of toluene and 30 parts of methyl ethyl ketone to obtain a polymer solution 1 (solids 30 mass %).

Preparation of Coating Resin Solution

| | |
|---|---|
| Polymer solution 1 (resin solids concentration 30%) | 33.3 mass % |
| Toluene | 66.4 mass % |
| Carbon black | 0.3 mass % |

(primary particle size 25 nm, nitrogen adsorption specific surface area 94 $m^2/g$, DBP oil absorption 75 mL/100 g)

These materials were dispersed for 1 hour with a paint shaker using zirconia beads 0.5 mm in diameter. The resulting dispersion was filtered with a 5.0 μm membrane filter to obtain a coating resin solution 1.

Magnetic Carrier Manufacturing Example

Resin Coating Step

The coating resin solution 1 was added to a vacuum degassing-type kneader maintained at normal temperature in the amount of 2.5 parts of the resin component per 100 parts of the magnetic core particle 1. This was then stirred for 15 minutes at a rotational speed of 30 rpm, and once at least a specific amount of the solvent (80 mass %) had evaporated, the temperature was raised to 80° C. with mixing under reduced pressure, the toluene was distilled off over the course of 2 hours, and the mixture was cooled. A magnetic dressing was used to separate the low-magnetic component from the resulting magnetic carrier, which was then passed through a 70 μm sieve and classified with an air classifier to obtain a magnetic carrier with a median diameter of 38.2 μm on a volume basis.

Toners 1 to 33 (Examples 1 to 24, Comparative Examples 1 to 9)

The Toner 1 and the magnetic carrier were mixed at 0.5 $s^{-1}$ for a rotation time of 5 minutes with a V-shaped mixer (V-10, Tokuju Corporation) to a toner concentration of 10 mass % to obtain a two-component developer 1. Two component developers 2 to 33 were also obtained by mixing the Toners 2 to 33 with the magnetic carrier in the same way.

The following evaluations were performed using the resulting two-component developers. The evaluation results are shown in Table 3.

Toner performance was evaluated by the following methods (1) to (3).

(1) Image Density Fluctuation

An imagePRESS C800 full-color copier (Canon Inc.) was used as the image-forming apparatus (using the Cy station).

The developing voltage was initially adjusted so that the toner laid-on level of an FFh image was 0.45 $mg/cm^2$. "FFh" is a value obtained by displaying 256 gradations in hexadecimal notation, with 00h being the first of the 256 gradations (white background) and FFh the 256th gradation (solid part).

An image output endurance test was performed by outputting 10,000 sheets of a solid image with a 50% image duty in a normal-temperature, low humidity environment (23° C., 5% RH), and the reflected density fluctuation rates of all images were measured. CS-680 plain copy paper (A4, basis weight 68 $g/m^2$, purchased from Canon Marketing Japan Inc.) was used as the evaluation paper. The image densities of all of the output images were measured with an X-Rite color reflection densitometer (500 Series: X-Rite, Incorporated), and the standard deviation of the fluctuation in image density was calculated. The standard deviation of the fluctuation in image density was then ranked according to the following evaluation standard. During continuous paper feed of the 10,000 sheets, paper feed was performed under the same developing conditions and transfer conditions (without calibration) as for the first sheet. A grade of D or more is considered good.

A: Standard deviation less than 0.02
B: Standard deviation 0.02 to less than 0.05
C: Standard deviation 0.05 to less than 0.10
D: Standard deviation 0.10 to less than 0.20
E: Standard deviation 0.20 or more (2) Evaluation of Density Uniformity Following the endurance test of (1) above, in a normal-temperature, low humidity environment (23° C., 5% RH), a screen halftone image with an average reflected density of 0.80 was output on A3 size paper, and the density uniformity was evaluated.

CS-680 plain copy paper (A3, basis weight 68 $g/m^2$, purchased from Canon Marketing Japan Inc.) was used as the evaluation paper.

The image density at 45 locations on the sheet was measured with a 500 series spectral densitometer (X-Rite, Incorporated), and the variation was evaluated according to the following standard based on the standard deviation. A grade of D or more is considered good.

A: Standard deviation less than 0.010
B: Standard deviation 0.010 to less than 0.030
C: Standard deviation 0.030 to less than 0.050
D: Standard deviation 0.050 to less than 0.080
E: Standard deviation 0.080 or more (3) Evaluation of Fogging Following the endurance test of (2) above, the conditions were changed to a high-temperature, high-humidity environment of 30° C., 80% RH, the copier was left for 1 day, a solid white image (image density 0, image duty 0%) was output on A3 size paper, and fogging of the white background was evaluated.

CS-680 plain copy paper (A3, basis weight 68 g/m$^2$, purchased from Canon Marketing Japan Inc.) was used as the evaluation paper.

The fogging density was measured at 9 locations on the sheet with a reflection densitometer (model TC-6DS, Tokyo Denshoku Co., Ltd.), and the average value at the 9 locations was given as the fogging density. The results were evaluated according to the following standard. A grade of D or more is considered good.

A: Fogging density less than 0.2

B: Fogging density 0.2 to less than 0.4

C: Fogging density 0.4 to less than 0.6

D: Fogging density 0.6 to less than 1.0

E: Fogging density 1.0 or more

TABLE 3

| Example No. | Developer No. | (1) Density fluctuation (standard deviation) | (2) Density uniformity (standard deviation) | (3) Fogging |
|---|---|---|---|---|
| Ex. 1 | 1 | A (0.01) | A (0.004) | A (0.1) |
| Ex. 2 | 2 | A (0.01) | A (0.007) | B (0.3) |
| Ex. 3 | 3 | A (0.01) | A (0.009) | C (0.5) |
| Ex. 4 | 4 | A (0.01) | A (0.009) | D (0.6) |
| Ex. 5 | 5 | A (0.01) | B (0.013) | D (0.7) |
| Ex. 6 | 6 | A (0.01) | B (0.017) | D (0.7) |
| Ex. 6-2 | 6-2 | A (0.01) | C (0.034) | D (0.7) |
| Ex. 7 | 7 | A (0.01) | C (0.032) | D (0.8) |
| Ex. 8 | 8 | B (0.02) | C (0.032) | D (0.8) |
| Ex. 9 | 9 | B (0.03) | C (0.036) | D (0.8) |
| Ex. 10 | 10 | B (0.04) | C (0.038) | D (0.8) |
| Ex. 11 | 11 | B (0.04) | C (0.038) | D (0.8) |
| Ex. 12 | 12 | C (0.06) | C (0.035) | D (0.8) |
| Ex. 13 | 13 | C (0.08) | C (0.036) | D (0.8) |
| Ex. 14 | 14 | B (0.04) | C (0.036) | D (0.8) |
| Ex. 15 | 15 | B (0.02) | C (0.037) | D (0.8) |
| Ex. 16 | 16 | B (0.04) | C (0.037) | D (0.8) |
| Ex. 17 | 17 | B (0.02) | C (0.038) | D (0.8) |
| Ex. 18 | 18 | B (0.03) | C (0.042) | D (0.8) |
| Ex. 19 | 19 | B (0.03) | C (0.040) | D (0.8) |
| Ex. 20 | 20 | C (0.09) | C (0.041) | D (0.8) |
| Ex. 21 | 21 | D (0.11) | C (0.041) | D (0.8) |
| Ex. 22 | 22 | D (0.17) | C (0.043) | D (0.9) |
| Ex. 23 | 23 | D (0.19) | C (0.043) | D (0.9) |
| Ex. 24 | 24 | D (0.19) | C (0.043) | D (0.9) |
| Comparative ex. 1 | 25 | E (0.26) | C (0.048) | D (0.9) |
| Comparative ex. 2 | 26 | E (0.22) | C (0.047) | D (0.7) |
| Comparative ex. 3 | 27 | E (0.30) | C (0.046) | E (1.0) |
| Comparative ex. 4 | 28 | E (0.29) | E (0.080) | D (0.8) |
| Comparative ex. 5 | 29 | E (0.30) | C (0.041) | D (0.9) |
| Comparative ex. 6 | 30 | E (0.31) | C (0.041) | D (0.9) |
| Comparative ex. 7 | 31 | E (0.32) | C (0.041) | D (0.9) |
| Comparative ex. 8 | 32 | E (0.51) | D (0.059) | D (0.8) |
| Comparative ex. 9 | 33 | E (0.43) | D (0.066) | D (0.8) |

As shown by the above results, the toner of the present invention is satisfactory in terms of environmental stability and durability and yields stable images in a variety of temperature and humidity environments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-114211, filed Jun. 9, 2017, which is hereby incorporated by reference herein in its entirety.

What is claimed is:

1. A toner comprising: a toner particle containing a binder resin; and an inorganic particle, wherein the inorganic particle contains a silicon oxide particle with a number-average particle diameter (D1) from 50 nm to 300 nm and a strontium titanate particle with a number-average particle diameter (D1) from 10 nm to 60 nm, the content of the silicon oxide particle is from 0.5 mass parts to 15.0 mass parts per 100 mass parts of the toner particle, the content of the strontium titanate particle is from 0.02 to 5.00 times the content of the silicon oxide particle, and in dielectric constant measurement at 25° C. and 1 MHz, the dielectric constant of the silicon oxide particle is from 1.0 pF/m to 20.0 pF/m, and the dielectric constant of the strontium titanate is from 25.0 pF/m to 100.0 pF/m.

2. The toner according to claim 1, wherein the volume resistivity of the strontium titanate particle is from $2.0\times10^9$ Ω·cm to $2.0\times10^{12}$ Ω·cm.

3. The toner according to claim 1, wherein the content ratio of cubic and cuboid shaped particles in the strontium titanate particle is not more than 40% by number.

4. The toner according to claim 1, wherein the content ratio of cubic and cuboid shaped particles in the strontium titanate particle is not more than 4% by number.

* * * * *